United States Patent [19]

Thomas

[11] 4,249,419

[45] Feb. 10, 1981

[54] MICROPIPETTE SYSTEM

[76] Inventor: Bradley S. Thomas, 2316 Harcroft Rd., Timonium, Md. 21093

[21] Appl. No.: 1,394

[22] Filed: Jan. 5, 1979

[51] Int. Cl.[3] ..... B01L 3/02

[52] U.S. Cl. ..... 73/425.6

[58] Field of Search ..... 73/425.6; 222/309, 386; 422/100

[56] References Cited

U.S. PATENT DOCUMENTS

| | | | |
|---|---|---|---|
| 3,494,201 | 2/1970 | Roach . | |
| 3,815,790 | 6/1974 | Allen . | |
| 4,023,716 | 5/1977 | Shapiro . | |
| 4,084,730 | 4/1978 | Franke et al. | 73/425.6 |

*Primary Examiner*—S. Clement Swisher

*Attorney, Agent, or Firm*—John F. McClellan, Sr.

[57] ABSTRACT

A micropipette system provides one-hand operation to jettison a disposable tip assembly of pipette barrel and plunger when used, to engage and automatically calibrate a fresh tip assembly; to select aliquot setting desired from a visible scale also providing positive, tactile-click setting signals, and also by choice of automatically accommodated tip assembly diameters to provide different aliquot ranges, and to draw in and to discharge the aliquot portions chosen, by means of a mechanism comprising substantially only the elements of actuator shaft element, return and grip springs and housing; clearance shaft element, pipette barrel, vise with grip spring and plunger; and automatic calibration coacting pipette-tip packaging, except for springs, all of which may be plastic.

19 Claims, 10 Drawing Figures

MICROPIPETTE SYSTEM

This invention relates generally to pipettes and specifically to hand manipulable micropipette systems.

Principal objects of the invention are to provide a simple, economical micropipette system which will eliminate most causes of error and contamination, while at the same time affording easy, one hand manipulation for all operations.

In the prior art numerous micropipettes have been described including the plunger operated, manually held micropipettes, some with disposable tip portions, disclosed in the following U.S. Pat. Nos.:

3,494,201 to W. J. Roach, 2-10-70;

3,815,790 to D. M. Allen et al, 6-11-74;

4,023,716 to J. J. Shapiro, 5-17-77.

Further objects are to provide a system as described with aliquot settings which apply consistently to different-diameter, disposable tip assemblies of different capacities which are acceptable by the system, the only change being in range; in which the pipette actuator assembly provides good visual access to operations conducted with it but is large enough to prevent contamination through introduction into a test tube; and in which all mechanism is compactly contained and manufacturable to relatively loose tolerances, and in which separate controls reduce the possibility of erroneous use.

Still further objects are to provide a system as described which is durable, pleasing in appearance and speedy in operation.

In brief summary given as cursive description and not as limitation, the invention includes an actuator system operable by one hand to eject and replenish automatically calibratable tip assemblies and to load and dispense selectable quantities of fluid.

The above and other objects and advantages of the invention will become more readily apparent on examination of the following description, including the drawings, in which like reference numerals refer to like parts:

FIGS. 6, 7, 9 and 10 are out of scale.

Figure 1:
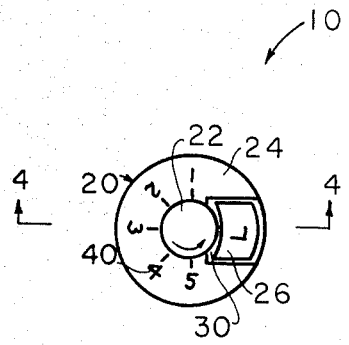
FIG. 1 is a top plan view.
Figure 2:
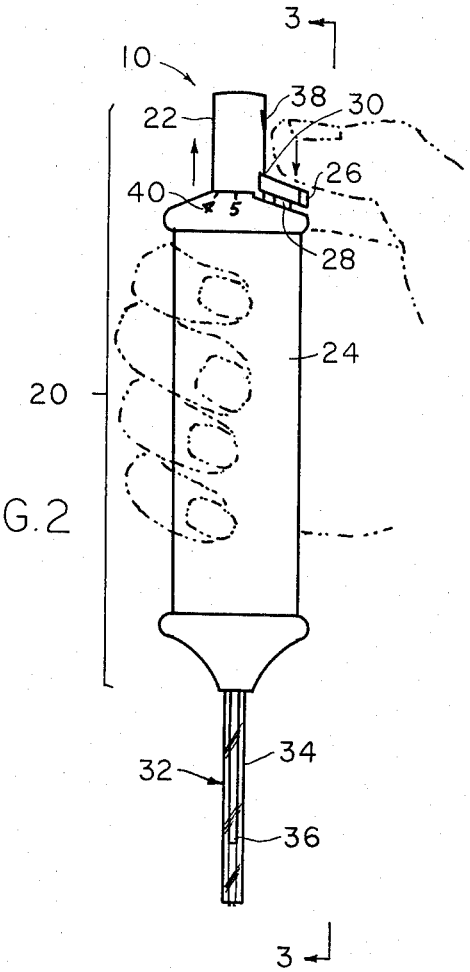
FIG. 2 is an elevational view.

FIGS. 1 and 2 show exterior features of an embodiment 10 of the invention: (a) actuator assembly 20, including the knob 22 which coaxially projects upwardly from the actuator shaft in housing 24, the cap 26 of clearing shaft 28 which projects upwardly from the housing alongside the actuator knob and has a cutout 30 partially encircling the actuator knob; and (b) a disposable pipette tip assembly 32 which coaxially projects downward from the housing, and comprises barrel 34 and plunger 36 within the barrel.

The position shown is that for ejection of used tip assembly and loading-with or engaging a fresh tip assembly, the rotary position of knob 22 being set at "L" for load and the clearing shaft being depressed (downward arrow) adapting the unit to release the spent tip assembly and receive a fresh one. The clearing shaft automatically rises when released and grips the fresh tip assembly.

To select aliquot quantity after installation of a fresh tip assembly the user merely extends thumb and forefinger upward while gripping the housing with the other fingers, and rotates the pointer knob 38 on knob 22 (circular arrow) to any desired indicium 40 away from the load position. The load position may have a safety detent to prevent slipping out of the load position accidentally by requiring a slight downward pressure while turning away from it.

To fill the apparatus, the actuator shaft, which is integral with the knob is rotated, to the cam step for the stroke length desired. As it is turned it rises (upward arrow) in discrete steps corresponding to the indicia, each step being signalled by a click-stop detent relation; significant force is required to move it away from any designated position. To fill at the selected position the knob is depressed fully and then released to draw in fluid.

To dispense any selected aliquot the knob is simply depressed by thumb or finger.

As indicated, with the knob and actuator shaft thumb-depressed fully in the "down" position, the tip of the pipette plunger 36 extends beyond the barrel 34 a small predetermined distance sufficient to assure delivery of the full aliquot.

Figure 3:
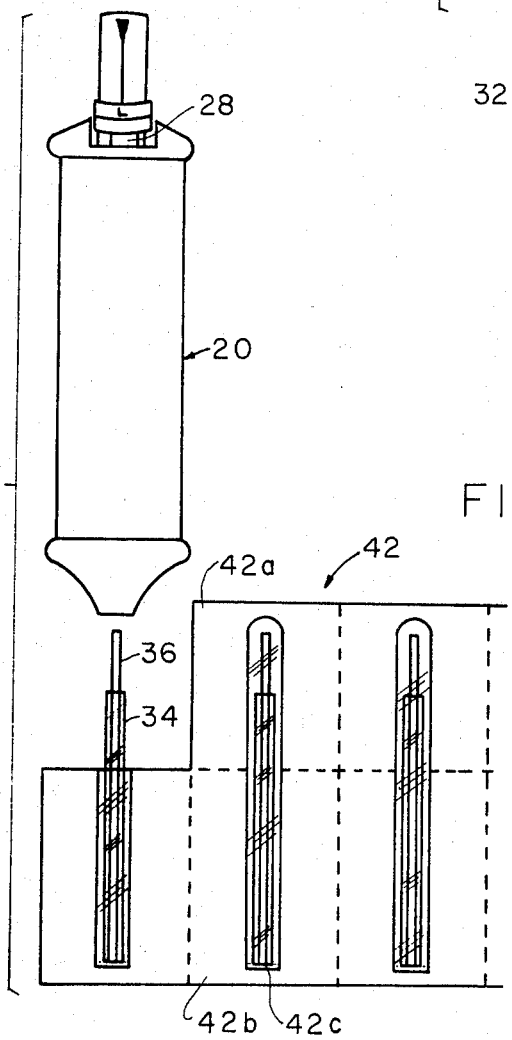
FIG. 3 is an elevational view taken at 3—3, FIG. 2.

FIG. 3 shows exterior details of the automatic-calibration sterile individual tip engaging system; still only one-hand operation is required.

The user merely strips the tearoff top **42*a* from one compartment 42*b* in a unitary series 42 or strip of tip assembly containing hermetic compartments, then with the actuator assembly still in the "L" position, presses the actuator assembly 20 as far as it will go downward in receiving the tip assembly, the barrel striking internal structure to be described, then releases the clearing shaft 28 to grip the fresh tip assembly, and lifts the actuator assembly, withdrawing the fresh pipette tip assembly of barrel 34 and plunger 36 from the package, gripped in calibrated relation, ready to use. Pipette tip assembly calibrated relation is automatically provided by preserving the as-packaged axial relation of the plunger and barrel, the lower ends of which rest flush against the bottom 42*c*** of the package. The actuator assembly of this invention fixes this as-packaged axial relation of plunger and barrel in engaging and gripping the plunger and barrel, by simple means described in reference to the following Figures.

Figure 4:
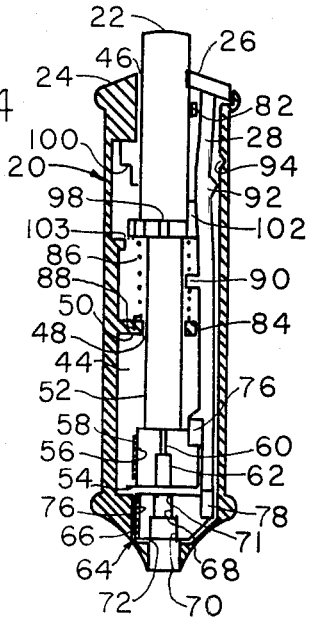
FIG. 4 is a partially sectional elevational view adapted from 4—4, FIG. 1.

FIG. 4 diagrams the interior relation of the previously referred to actuator assembly 20 including housing 24, actuator knob 22, and clearing cap 26 and shaft 28 and shows the following additional details. The housing is generally tubular in shape; the interior opening 44 has an upper passage 46 slidably and rotatably containing the knob, and a lower passage 48 in a strut 50 intermediate the length of the housing slidably and rotatably containing the actuator shaft 52 near the lower end.

The lower end of the actuator shaft comprises a gripper engaging the projecting upper end of the releasable pipette plunger. It may be a split collet 54, one half of which is shown, with an integral, vertical hinge portion 56 at one side. Polypropylene hinges well, but any other suitable plastic can be used for the actuator shaft. A flat, semi-circular spring 58 encompassing the split collet may be used for resiliently holding it closed. Coaxial, stepped bores 60, 62 in the split collet permit reception of plungers of different sizes to vary predeterminably the pipette capacity range.

For correspondingly gripping pipette barrels of different diameters, with correspondingly different capacities, and holding them fixed to the housing for pipette operation, a similar split-collet type structure or vise 64 also closed by a spring 66 and having stepped-diameter coaxial bores 68, 70, and an upper shoulder 71 is held coaxially in a recess 72; the recess is laterally large enough to permit the vise to open. The vise may also have an integral hinge portion 76.

Only the relative positions of the plunger and barrel in the overlength gripping means affect calibration; absolute position does not.

The clearing shaft opens the split collet 54 and the vise 64 simultaneously for respectively jettisoning used pipette tip assemblies, and for receiving, and upon retraction closing around and gripping at the same time a fresh pipette plunger and barrel.

For this, the clearing shaft 28 has on it axially-spaced first and second downwardly pointing wedges 76, 78 for respectively entering the vertical junction spaces respectively between the jaws of the split collet 54 and of the vise 64. The wedges preferably have concave faces.

To permit the necessary downward axial motion providing the simultaneous wedging apart of the two sets of jaws, the clearing shaft is held slidably in the housing in parallel with the actuator shaft by means of fit of the cap 26 on the knob 22, by a passage 82 near the top, and by one or more pairs of opposed lugs 84 intermediate the length of the housing.

Retraction of the dual-wedge action to permit the simultaneous gripping of a fresh plunger and barrel is by means of upwardly biasing compression coil-spring 86 which encircles the actuator shaft and has the lower end of the spring wire inserted in a hole 88 in the housing to prevent twisting of the spring. Tab 90, laterally projecting as part of the clearing shaft engages the spring, and with the clearing shaft, is thrust upwardly under spring bias, adjustably on assembly depending on the number of turns of the spring positioned below the tab on assembly.

Preventing the clearing shaft from being thrust upwardly by the spring beyond the design axial position may be accomplished by the relative positions of the upper wedge and the strut structure 50 which it can strike at the upper limit of travel, or by other equivalent structure.

Holding the clearing shaft clear of the downward position at which the wedges begin to function is accomplished by inclined-surface detent protrusion 92 on the clearing shaft which fits into recess 94 in the inner wall of the housing. This precludes accidental ejection of the pipette assembly. The flange notches clear but confine the clearing shaft at all aliquot settings except the "load" or "L" position at which an extra deep one of the notches 98 or recessed portion in the periphery of the arcuate flange 96 permits releasing it by flexure of the clearing shaft resultant to downward manual pressure on the cap which causes the incline of the detent protrusion to slip out of the recess.

At all other positions the notches correspond in rotation respectively to steps 100 in the inner wall of the housing, which steps comprise a stepped cam for cam follower 102 which integrally projects in radial direction from the actuator shaft in position to engage the steps in ascending (or decending) sequence, depending on in which of the indicia-indicated positions the knob is placed. The notched structure thus can click from one position to the next under the coacting resilient opposition of the flexed clearing shaft at between-step positions, giving visual, tactile and audible indication of rotary setting of aliquot quantity.

It will be noted that these indications are advantageously the same for any diameter tip assembly employed; the absolute quantity (but not percentage of stroke) being determined by tip assembly diameter-e.g. a red-colored tip assembly might have twice the capacity at each setting of a white-colored tip assembly.

Finally, as to this Figure, an extra one-half millimeter clearance 103 beneath the dashed line showing cam follower position at the lowest or load position is provided; this permits thrusting the plunger down to clear the last drop.

Figure 5:
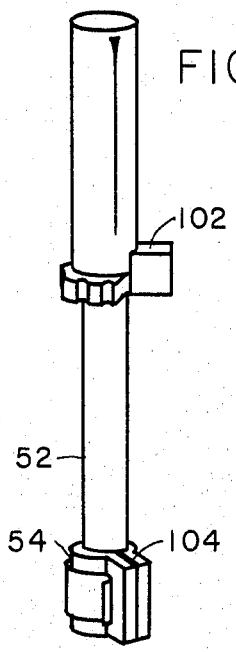
FIG. 5 is a perspective detail of an actuator.

FIG. 5 shows the actuating shaft 52 apart from the assembly. The top of the collet 54 should have a "V"-shaped recess 104 at the junction of the jaws to accept and guide the wedge which opens the jaws.

Figure 6:
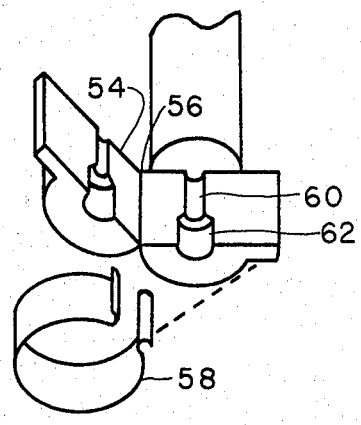
FIG. 6 is a fragmentary detail of an actuator pipette plunger gripper or chuck.

FIG. 6 details the collet 54, showing it in wide-open position for exposition of the differing diameter bores 60, 62 to fit differing pipette plungers, and showing the plastic hinge portion 56; spring clip 58 is shown disassembled.

Figure 7:
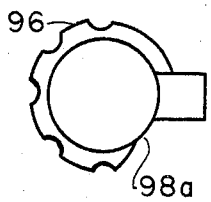
FIG. 7 is a top plan detail of an actuator notched flange and cam follower.

FIG. 7 shows in plan detail the notched flange 96 of the assembly; the big notch **98*a*** frees the clearing shaft to be depressed at the "L" or pipette tip assembly load position.

Figure 8:
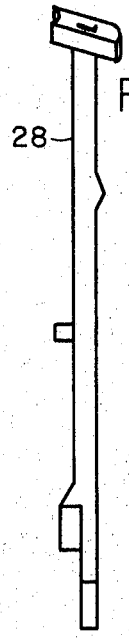
FIG. 8 is a perspective detail of a clearing shaft.

FIG. 8 shows the clearing shaft 28 apart from the assembly. This may also be of polypropylene, and the housing and pipette tips also, if desired, or of other suitable plastic. The housing could be made of metal.

Figure 9:
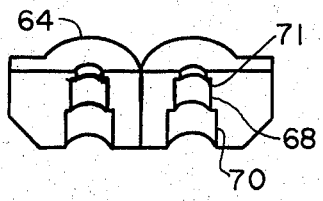
FIG. 9 is a perspective detail of a pipette barrel gripper or vise.

FIG. 9 details the vise 64 in wide-open position to show the different diameter bores 68, 70, for gripping different-diameter pipette barrels. In this, as in the chuck, the bores or gripping surfaces are made long enough to permit bottoming on insertion of the plunger, for example, without bottoming of the barrel (or vice versa, if desired) to preserve as-packaged longitudinal relation or calibration of the two. Stopping of the lower end of the plunger at a predetermined position just below the barrel lower end is a function of stroke, determined by proper location of the lug 74 in the next Figure as a matter of manufacture. Preferably the barrel is manufactured in two hemicylinder-like halves and cemented together for assembly.

Figure 10:
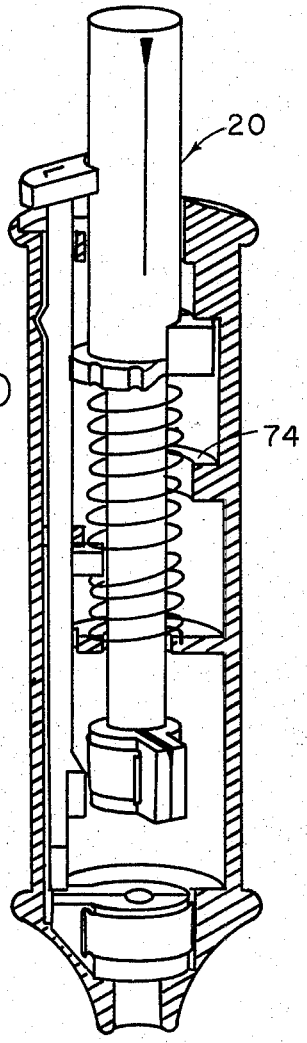
FIG. 10 is a perspective view in partial section of the actuator assembly.

FIG. 10 is a perspective view showing in partial section the relation of the parts. Although the housing is shown with section lines, it could as well be manufactured in two parts noted, that part shown being one of them, and joined by adhesive, completing the actuator assembly 20.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for micropipetting having a housing with plunger-reciprocating means for drawing in and dispensing fluid through disposable tip structure, the improvement comprising: the disposable tip structure including a barrel, a plunger within the barrel and means for simultaneously replacing the plunger and barrel together by one-hand operation; the means for simultaneously replacing including means for separately gripping the plunger and barrel and movable from a released condition to a gripping condition to grip the plunger and barrel simultaneously.

2. In a system as recited in claim 1, the means for simultaneously replacing including automatic calibration means for relating the axial positions of the plunger and barrel.

3. In a system for micropipetting having a housing with plunger-reciprocating means for drawing in and dispensing fluid through disposable tip structure, the improvement comprising: the disposable tip structure including a barrel, a plunger within the barrel and means for simultaneously replacing the plunger and barrel together by one-hand operation; the means for simultaneously replacing having automatic calibration means for relating the axial positions of the plunger and barrel, including first gripping means for the plunger, second gripping means for the barrel, and a single means operating said first and second gripping means.

4. In a system for micropipetting having a housing with plunger-reciprocating means for drawing in and dispensing fluid through disposable tip structure, the improvement comprising: the disposable tip structure including a barrel, a plunger within the barrel, means for replacing the plunger and barrel together in one-hand operation including: automatic calibration means for relating the axial positions of the plunger and barrel, first gripping means for the plunger and second gripping means for the barrel, and means for simultaneously operating the first and second gripping means to release and to grip.

5. In a system as recited in claim 4, the first and second gripping means comprising respectively a split collet on the plunger reciprocating means having closure biasing means and a split-vise having closure biasing means and fixed in axial relation with the split collet in the housing; the means for simultaneously operating including a clearing shaft having reciprocatable mounting alongside the plunger reciprocating means, and having wedge structure located for engaging and opening the respective splits of the split-collet and split-vise.

6. In a system as recited in claim 5, means for selecting different predeterminable quantities for dispensing, including the plunger reciprocating means comprising an actuator shaft with rotatable mounting in the housing, the actuator shaft and the clearing shaft having respective upward protrusion from the housing for manual manipulation thereof, means upwardly biasing the actuator shaft, stepped-cam structure, and a cam follower on the actuator shaft located for coacting with the stepped-cam structure to establish plural axial positions for the actuator shaft in succession upon rotation of the actuator shaft.

7. In a system as recited in claim 6, the plunger reciprocating means having a flange with a series of notches thereon respectively corresponding to the steps of said stepped-cam structure, and means for resiliently engaging said notches in succession as the actuator shaft is rotated.

8. In a system as recited in claim 7, said resiliently engaging means resiliently engaging the notched flange structure only at positions corresponding to between-step positions of the stepped-cam structure and being free of the actuator shaft when at said positions corresponding to the steps.

9. In a system as recited in claim 8, said means for resiliently engaging comprising the clearing shaft.

10. In a system as recited in claim 9, the clearing shaft and the housing having reciprocation-restraining detent structure including a protrusion having incline-engagement with a recess, and at least one of said notches on the flange proportioned for preventing disengagement of said detent structure.

11. In a system as recited in claim 10, said flange having a recessed portion positionable proximate the detent structure upon rotation of the actuator shaft for clearing and permitting reciprocation of the clearing shaft.

12. In a system as recited in claim 11, means upwardly biasing the clearing shaft.

13. In a system as recited in claim 12, the means upwardly biasing the actuator shaft comprising a coil compression-spring coaxial therewith below the flange, the means upwardly biasing the clearing shaft comprising a lateral projection therefrom engaging an intermediate portion of said coil compression-spring.

14. In a system as recited in claim 13, means for assembly-adjustment of said upward bias of the clearing shaft, comprising the coil compression-spring being rotatable about said axis for adjusting the number of coils below said lateral projection, and means for fixing the position of said rotation of the coil compression-spring.

15. In a system as recited in claim 6, the means for selecting different predeterminable quantities for dispensing comprising: the split collet and the split vise having respective axially-stepped bores for receiving repectively plungers of different diameters and barrels of different diameters.

16. In a system as recited in claim 6, the automatic calibration means comprising: the plunger extending upwardly beyond the barrel and the plunger and barrel being in flush relation at the lower end for loading, and a loading position of the actuator shaft in which the axial relation of said split collet and split vise respectively is proportioned for preserving said flush relation while receiving and gripping the plunger and barrel.

17. In a system as recited in claim 16, means for holding the plunger and the barrel in said flush position for loading.

18. In a system as recited in claim 17, the holding means including a hermetic package with the plunger and tip flush against the bottom thereof and having an openable top.

19. In a system as recited in claim 18, said top having provision for opening by tearing, and a plurality of said packages having connection forming a strip.

* * * * *